United States Patent [19]

Sherman

[11] Patent Number: 4,865,109

[45] Date of Patent: Sep. 12, 1989

[54] APPARATUS FOR OPENING AND CLOSING A WINDOW SHADE OR THE LIKE

[76] Inventor: Roger W. Sherman, 234 Baby Doe Dr., Leadville, Colo. 80461

[21] Appl. No.: 126,358

[22] Filed: Nov. 30, 1987

[51] Int. Cl.[4] ..... E06B 9/20

[52] U.S. Cl. ..... 160/321; 160/277

[58] Field of Search ..... 160/321, 277, 168.1, 160/169, 170, 173; 192/415

[56] References Cited

U.S. PATENT DOCUMENTS

| | | | |
|---|---|---|---|
| 4,621,673 | 11/1986 | Georgopoulas et al. | 160/168.1 |
| 4,671,396 | 6/1987 | Katamaki | 192/415 |
| 4,681,279 | 7/1987 | Nakamura | 160/294 X |
| 4,751,953 | 6/1988 | Appel et al. | 160/321 X |

*Primary Examiner*—Blair M. Johnson

*Attorney, Agent, or Firm*—Edwin L. Spangler, Jr.

[57] ABSTRACT

A positive drive for window shades and the like is characterized, first of all, by an opposed pair of channel-shaped tracks confining the right and left side margins of the shade and each also housing one run of an endless chain reaved under a pulley at the bottom and over a sprocket at the top. The bottom of the shade carries a rigid hem bar having eyelets in its ends sized to pass the chain but not a pair of stops carried by the latter that engage the hem bar and unwind the shade off the roller it is wound upon at the top when an exposed run of one of the chains is pulled. Right and lefthand one-way clutches are interposed between the sprockets and roller operative when the shade is lowered to disengage and permit relative rotational movement between the shade drive mechanism and the roller until the stops engage the eyelets in the hem bar. These same clutches engage when the shade is raised to link the drive mechanism and shade roller together for conjoint rotation.

8 Claims, 3 Drawing Sheets

APPARATUS FOR OPENING AND CLOSING A WINDOW SHADE OR THE LIKE

BACKGROUND OF THE INVENTION

In recent years home heating costs have risen dramatically as have energy costs in general. Among those steps taken by the homeowner to reduce these costs have oftentimes taken the form of window coverings or so-called "thermal shades". While draperies and other loose-hanging coverings for the glassed-in areas of the home and office afford some protection from the escape of heat or, as the case may be, the influx of cold from the outside, they do not provide nearly the thermal protection of a close-fitting shade, especially those which are quilted, laminated or otherwise insulated.

The problem which arises with this kind of window coverings is that of maintaining an efficient and effective seal around the window casing, especially at its sides where a good deal of leakage occurs. It is important, of course, to maintain a dead air space if possible between the shade and the glass since air itself is a fair insulator. Such is the principle used in double-pane windows. While sealing the sides can be done and, as a matter of fact, has been done many times in the past, the mechanical system used to raise and lower the shade became somewhat of a nightmare.

FIELD OF THE INVENTION

It is to this problem that the present invention relates, specifically, the provision of a greatly improved mechanical system for opening and closing a window shade, most especially those thermal shades and the like in which the side margins thereof are confined and housed in tracks of some description in the casing or some attachment thereto.

DESCRIPTION OF THE RELATED ART

The traditional way of operating a window shade is by means of a spring-wound roller of the general type exemplified by the early patent to Hartshorn U.S. Pat. No. 662,148; however, such an arrangement is only effective to assist in raising the shade and it does nothing insofar as lowering it. As a matter of fact, considerable care must be exercised in pulling the shade down or it will become skewed on its roller.

Chain drives for raising and lowering window shades, even beaded chain ones, are also well known in the art, the patents to Nisenson et al U.S. Pat. No. 3,135,369; Berman et al U.S. Pat. No. 4,323,105 and Rombouts U.S. Pat No. 4,448,233 being examples thereof. These chain drives, however, are devoid of several features of the present invention, not the least of which is a pair of one-way clutches that cooperate with stops carried by the chains and eyelets at the ends of the so-called hem bar which insure that both sides of the shade move together.

A number of other prior art patents disclose channel-shaped guideways receiving the side margins of the shade, some even having rollers at the ends of the hem bar while others are provided with wipers. Noteworthy of patents showing these features are the patents to Johnston U.S. Pat. No. 4,333,511 and Keller et al U.S. Pat. No. 4,357,978, both of which show insulated channel rails in which the side margins of the shade or screen slide. Again, however, the drive arrangement used to raise and lower the shades that forms the subject matter of the present invention is missing.

Spring clutches for use on window shade rollers are also well known, some being unidirectional and others bidirectional. One Jules Nisenson is either the sole or one of the joint inventors of several such clutches as seen in his U.S. Pat. Nos. 3,920,106; 4,253,554; 4,372,432; and 4,433,765. Insofar as applicant is aware, however, two one-way clutches that cooperate with one another and with a pair of chain-and-sprocket drives which include circumferentially-spaced stops that selectively engage stops carried by the lower outside corners of the shade to keep the lower edge thereof and its side margins tracking properly going both up and down are unknown in the prior art.

SUMMARY OF THE INVENTION

Accordingly, the present invention relates to a unique chain-and-sprocket drive for raising and lowering window shades having the side margins thereof confined within tracks which drive includes, among other things, a pair of one-way clutch elements cooperating with one another and with relatively movable abutments carried by the chain and shade to bring about simultaneous synchronous movement of both sides of the latter regardless of whether it is being pulled up or down. The drive mechanism is especially useful for use in connection with thermal shades where their side margins are frictionally held within insulated tracks and which are otherwise extremely difficult to raise and lower without them becoming cocked and skewed. Chain-and-sprocket drive systems are provided on both sides of the shade and each can be actuated independently of the other to move the shade in either direction.

Installation of the system is simple and it is readily adapted to existing window casings although it can be made a part of a prefabricated assembly. The unit is especially well suited for use in covering large window areas where the skewing problem is especially acute and bothersome. Also, while its primary application is, obviously, in covering windows, it will also function quite satisfactorily in horizontal position as a covering for skylights and other overhead installations.

It is, therefore, the principle object of the present invention to provide a novel and improved mechanism for raising and lowering window shades and the like.

A second objective is the provision of a mechanism of the type aforementioned which is equally workable in vertical or a horizontal position.

An additional object of the invention herein disclosed and claimed is to provide a shade drive mechanism which virtually insures that the shade will not become misaligned or otherwise skewed regardless of whether it is being raised or lowered or from which side it is being actuated.

Another objective of the within-described invention is that of providing a shade raising and lowering mechanism that is ideally suited for use with thermal shades and the like in which the side margins of the shade are confined within tracks as well as being frictionally held therein.

Still another object is to provide a mechanism for actuating window coverings of various types wherein the particular material out of which the shade is fabricated is of little significance in that it can be opaque or transparent, thick or thin, quilted or laminated or both, just so long as it can be wound on a roller and preferably doesn't stretch appreciably.

Further objects are to provide a mechanism for actuating window coverings which is simple yet effective, versatile, compact, easy to operate and install, lightweight, relatively inexpensive and even somewhat decorative.

Other objects will be in part apparent and in part pointed out specifically hereinafter in connection with the description of the drawings which follows.

DESCRIPTION OF THE PREFERRED EMBODIMENTS

Figure 1:
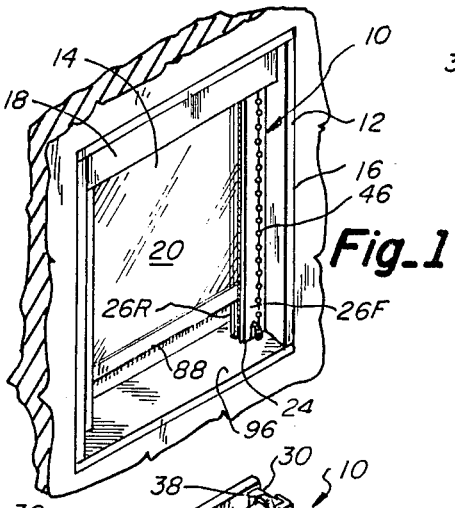
FIG. 1 is a fragmentary perspective view showing the window shade operating mechanism of the present invention installed within a window casing as seen from the front or vantage point of the operator.
Figure 4:
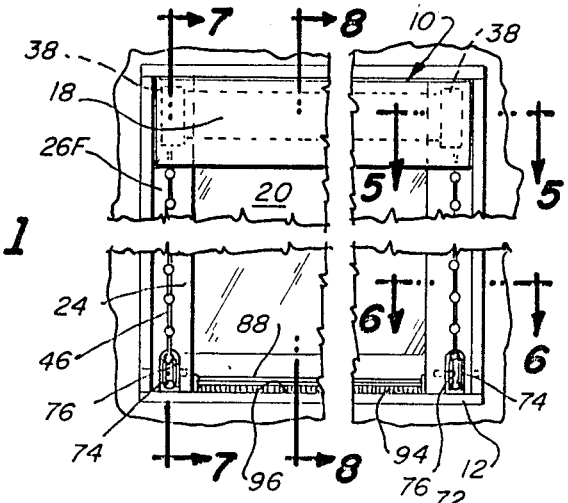
FIG. 4 is a front elevation of the complete assembly shown in FIG. 1 to a scale between that of the latter figure and FIG. 3, portions of which have been broken away to conserve space.

Referring next to the drawings for a detailed description of the present invention, reference numeral 10 has been chosen to broadly designate the window shade operating mechanism in its entirety and it will be seen in FIGS. 1 and 4 to be mounted within a conventional window casing 12 containing a window pane 14 mounted in a frame 16 (FIG. 1). Element 18 is a crosspiece extending across the top of the casing between its sideframe members which essentially does little more than cover up the elements of the assembly 10 located at the top of the window frame.

At the outset, it should, perhaps, be mentioned that while the mechanism 10 has been illustrated herein and will be described in the material that follows in connection with its use as a means for raising and lowering a window shade of the type covering a window carried in the frame disposed more or less vertically in a casing 12, it is by no means limited to such an application and it will function equally well in a horizontal position such as it might occupy covering the underside of an overhead skylight. In applications such as the latter, some additional structure might be required, but, this subject will be addressed in greater detail later as the construction of the chain-and-sprocket drives is described.

Figure 8:
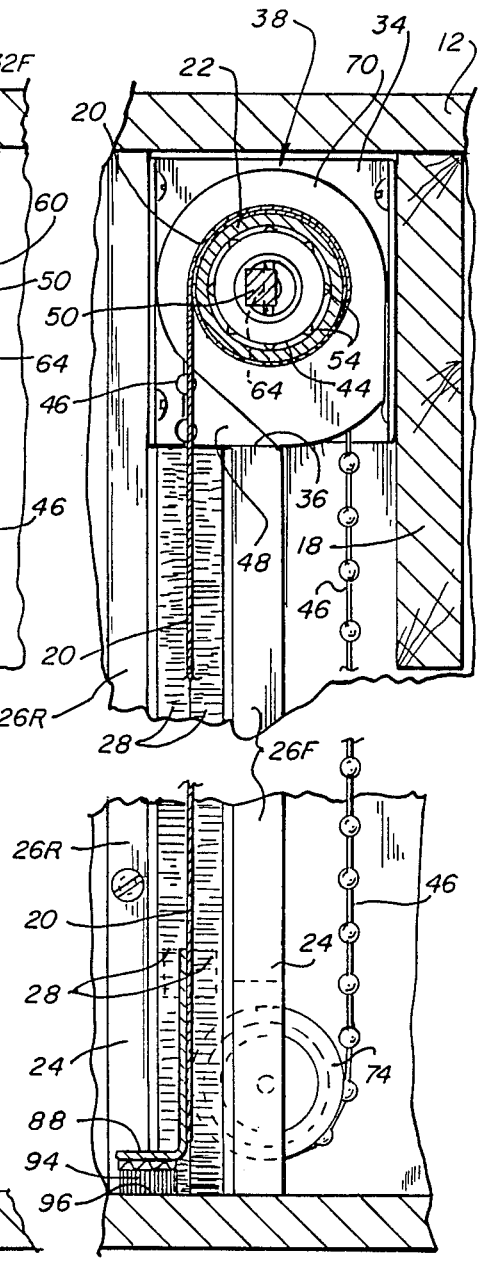
FIG. 8 is a fragmentary section taken along line 8—8 of FIG. 4 to the same scale as FIG. 7; and, FIG. 9 is an exploded view of the one-way clutch used in the right end of the shade roller to a scale approximately the same as that of FIGS. 7 and 8.

The shade 20 may take any one of several forms. For instance, it can be transparent and, perhaps, colored in some fashion to soften or block one part of the light. More commonly, the shade will be opaque and, in the manner of energy-saving applications, they are oftentimes quilted to comprise inner and outer layers of fabric in between which are sandwiched a layer of insulation. Regardless of what form the particular shade takes, it must be flexible enough to roll up on roller 22 in the manner shown most clearly in FIGS. 3, 5 and 8 while preferably having very little stretch.

Figure 6:
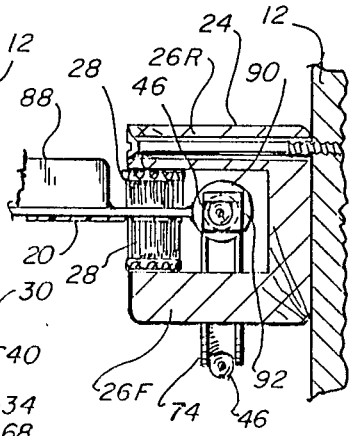
FIG. 6 is a fragmentary section taken along line 6—6 of FIG. 4 to the same scale as FIG. 5.

In FIGS. 1, 2, 4, 6, 7 and 8, and especially FIG. 6, it can be seen that the side margins of the shade ride within and are confined by opposed channel-shaped tracks 24 which are suitably fastened to the sides of the window casing. For insulating purposes, the front and rear flanges 26R and 26F, respectively, of these tracks are both shown lined along their free edges with a "furry" weatherstrip material 28 as seen in FIG. 6. The shade drive mechanism of the present invention becomes especially significant when such weatherstripping materials are used in that the friction developed with the edges of the shade is such that it has to even be driven upwardly since a spring roller is seldom, if ever, capable of developing the torque required to raise it without some assistance. Lowering the shade can still, of course, be done by hand, but, even this can become very difficult especially with a shade several feet wide.

Figure 2:
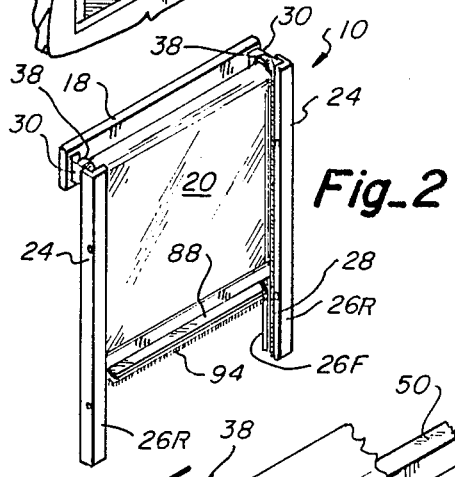
FIG. 2 is a perspective view much like FIG. 1 and to the same scale showing the shade operating mechanism removed from the casing as it appears from the rear instead of the front.
Figure 7:
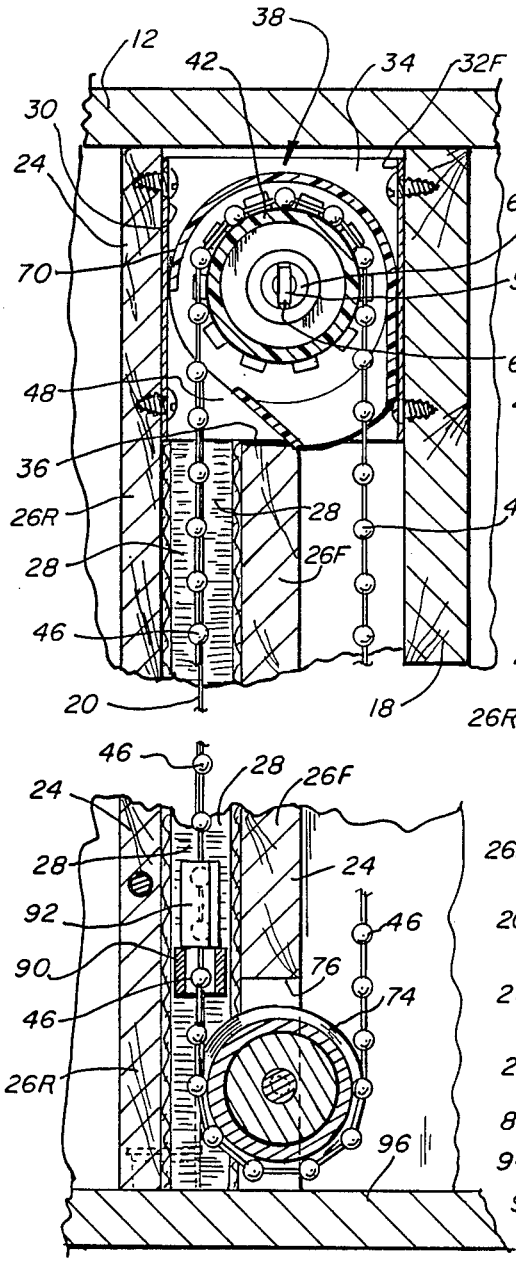
FIG. 7 is a fragmentary section taken along line 7—7 of FIG. 4 to and ever further enlarged scale than FIG. 3.

A pair of generally U-shaped brackets 30 are screwed or otherwise fastened to the front flanges 26F of the tracks at the top thereof as shown in FIGS. 2 and 7. The crosspiece 18 is, in turn, fastened to the front flanges 32F of these brackets as seen, once again, in FIG. 7. The webs 34 of these brackets lie in opposed relation to one another resting against the sideframe elements of the casing where they are held in place by the tracks which, as aforementioned, are fastened to the latter. In FIG. 7 of the drawings, it can be seen that the front flange 26F of these tracks 24 is foreshortened at the top to provide an upwardly-facing ledge 36 atop which the one-way clutch subassemblies indicated broadly by reference numeral 38 rest as shown confined front and rear between the flanges of the brackets and on the ends by the webs thereof. As such, in the particular form shown, these clutch subassemblies 38 together with the clutches 40, upper sprockets 42, end plugs 44 and beaded chains 46, all of which comprise parts thereof, merely drop into the pockets 48 thus formed and they require no attachment to either the brackets or tracks. Roller 22 and connecting shaft 50 cooperate with one another to maintain the clutch assemblies in fixed spaced relation to one another. These clutch assemblies are right and lefthanded; however, with the exception of FIG. 7, only the one on the righthand end of the roller has been shown in detail.

Figure 9:
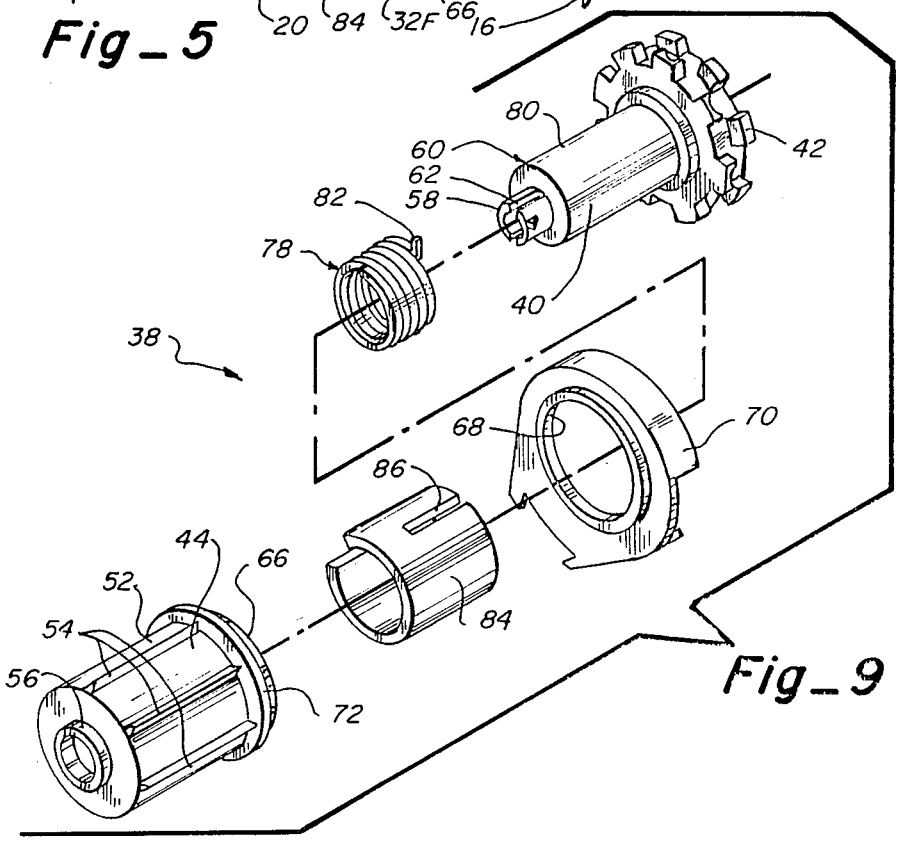

Next, with particular reference to FIGS. 3, 5, 7, 8 and especially FIG. 9 where the details of the one-way clutch subassembly 38 are shown, end plugs 44 are of conventional design and they consist of a generally cup-shaped insert 52, the exterior surface of which is ribbed as shown at 54 and sized to fit non-rotatably into an end of tubular roller 22. The inner end of the insert contains a central opening 56 (FIG. 5) within which the slotted end 58 of the inner clutch element 60 is journalled for relative rotation. The opposed slots 62 in these inner clutch elements 60 receive the tongues 64 on the opposite ends of the shaft 50 which interconnect these two clutch elements together for conjoint rotation relative to the roller 22, the shade 20 wound thereon and the end plugs 44 inserted into its ends. The outer cylindrical end 66 of the plug is journalled for free rotational movement inside the opening 68 provided therefor in sprocket housing 70. An annular flange 72 on the plug between its cylindrical and ribbed sections 54 and 66, respectively, defines an abutment effective to limit the penetration of the plug into the sprocket housing.

Figure 5:
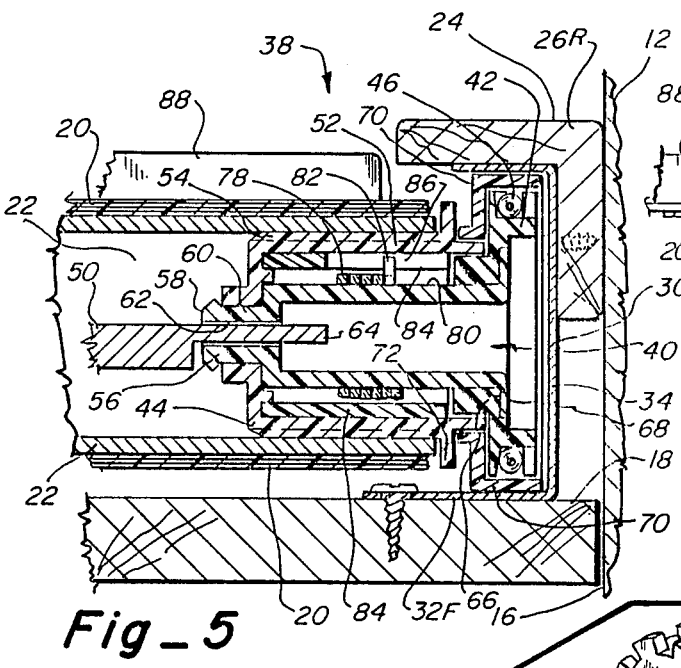
FIG. 5 is a fragmentary section taken along line 5—5 of FIG. 4 to a still further enlarged scale.

Non-rotatably fastened to the outer end of each inner clutch element 60 is a bead chain sprocket 42 which turns inside the sprocket housing 70. In the particular form shown, these housings are open on their outer ends leaving the sprockets 42 exposed, however, when seated in the pockets 34 provided therefor in the brackets 30, the webs 34 of the latter effectively enclose the sprockets as seen in FIG. 5.

Figure 3:
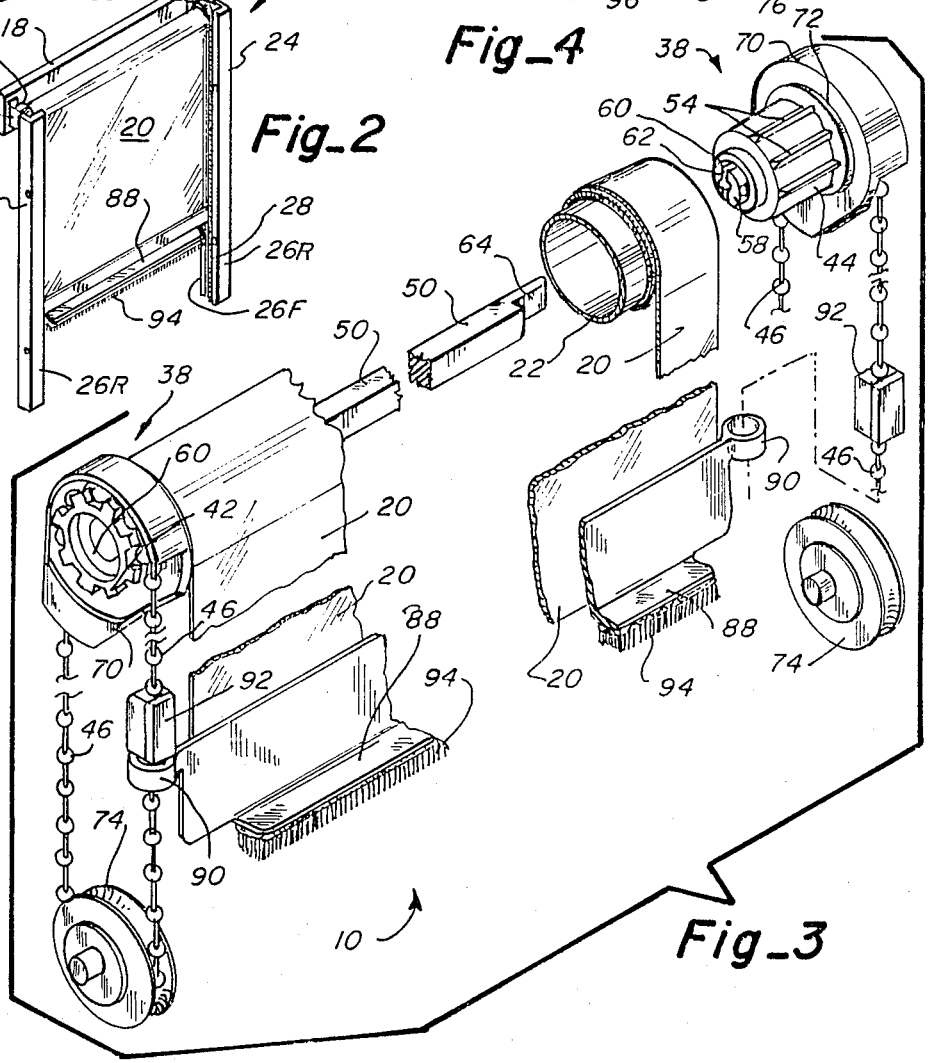
FIG. 3 is an exploded perspective view to a greatly enlarged scale showing the various elements of the mechanism in their operative relationships to one another, portions having been broken away to conserve space and more clearly reveal the interior construction.

An endless loop of bead chain 46 is reaved over each sprocket 42 and around underneath a pulley 74 journalled for rotation in a slot 76 (FIG. 7) provided therefor in the front flange 26F of the tracks 24. One run of the bead chain passes through the channel formed in the tracks while the other run passes outside the front flange of the latter where it is accessible to the operator as shown in FIG. 1. As illustrated in FIG. 3, the shade 20 is wound on roller 22 in a direction such that pulling down on the exposed run of either of the two bead chains is operative to lower the shade and, conversely, pulling up on the chain raises the shade.

Returning to FIGS. 3, 5 and 9 to complete the description of the one-way clutches 40, in the latter two figures it can be seen that a spring 78 is wound around the cylindrical body or hub 80 of each inner clutch element 60. Extending radially from one end of these springs is a tang 82. Non-rotatably fastened inside the body of cup-shaped plug 44 is the sleeve-like outer clutch element 84. This outer clutch element is provided with a longitudinally-extending slot 86 which receives the tang 82 of spring 78 thus forming the operative connection between the inner and outer clutch elements. Also, since the sprocket 42 is non-rotatably fastened to the inner clutch element 60 and the outer clutch element 84 is similarly fastened non-rotatably to the plug 44 which, in turn, is non-rotatably inserted into an end of the roller 22, a driving connection for turning the roller is thus provided by means of one of the bead chains 46. The elements of the one-way clutch assemblies 38, however, are only engaged to raise the shade, not lower it. This can best be explained with reference to FIGS. 3 and 9 to which detailed reference will now be made.

Spring 78 is wound on the hub 80 of the inner clutch element 60 such that when the tang 82 is pushed clockwise as shown in FIG. 9, it will tighten its coils around the hub and interconnect the inner and outer clutch elements for conjoint rotation. Conversely, when a force is applied to the tang 82 of the spring in a direction to unwind its coils, i.e. counterclockwise, it will slip on the hub 80 of the inner clutch element thus permitting it to turn relative to the outer clutch element. Translating the above into rotation of the roller to raise and lower the shade, it can be seen that if the operator were to pull down on the exposed run of either bead chain 46, the net effect of this action will be to turn the inner clutch element 60 clockwise, whereupon, the tang 82 held in slot 86 of the outer clutch element will tend to open the coils of the spring wound upon the hub 80 thus permitting the sprocket and associated elements to turn without producing corresponding rotation of the outer clutch element, plug 44 and the roller 22. On the other hand, if the operator were to lift up on either of the bead chains, the sprocket 42 associated therewith would be turned counterclockwise along with the inner clutch element 60 associated therewith. Counterclockwise rotation of the inner clutch element is going to function through tang 82 to tighten the coils of the spring around its hub 80 thereby locking the inner and outer clutch elements together for conjoint rotation in a direction to raise the shade by turning the plug 44 and the roller 22. All elements of the clutch assembly on the opposite end of the roller remote from the side actuated by the operator will turn in the same direction at the same speed because they are linked together by the roller, connecting shaft 50 and the other of the two clutches 40 which is also engaged and because the latter clutch is of the opposite hand.

Lowering the shade, however, is a different matter. Before describing this operation it will be helpful if certain other elements of the assembly are described in detail because they enter into it significantly. In FIGS. 1 and 6, it can be seen that a solid so-called "hem-bar" 88 with eyelets 90 at both of its ends is sewn or otherwise fastened to the bottom of the shade. These eyelets are sized to easily pass the beads of the bead chains. In the particular form shown, a brush-like weatherstrip 94 is affixed to the bottom of the hem-bar to seal against the sill 96 of the window casing thus providing an additional thermal barrier. The exposed run of each bead chain is also provided with a stop 92 which will not pass through the openings in the eyelets 90.

Having detailed these additional elements of the shade-operating mechanism, the manner in which the shade is lowered can now be described. As previously noted, the shade is shown wound upon the roller in a direction such that pulling down on one of the bead chain loops will cause the shade to be lowered. This, however, is not as simple as it might first appear. Assume, for example, that neither one of the stops 92 is in abutting relation to the eyelets 90. These stops will, however, be arranged in transverse alignment with each other because they are set up that way. Furthermore, they cannot move relative to one another because they are operatively linked together at all times through shaft 50, the inner clutch elements 60 and sprockets 42.

As the operator pulls down on one chain or the other, it will lower the stop associated therewith until it seats atop the eye. Pulling upon the chain, of course, causes the sprocket 42 and inner clutch element 60 associated therewith to turn also. However, these elements will now be turning clockwise relative to the outer clutch element 84 and, as already noted, when the sprocket and inner clutch element turn clockwise relative to the outer clutch element, tang 82 of spring 78 will function to loosen the coils of the latter upon inner clutch element hub 80 thereby permitting relative rotation of the latter without transmitting this motion to the roller 22 which, for the time being at least, remains stationary. The inner clutch elements 60 are, however, operatively interconnected for conjoint rotation at all times independent of roller 22 by connecting shaft 50; therefore, the one-way clutch 40 on the side of the shade remote from the chain being pulled upon will also be disengaged and free to rotate relative to the roller and shade wound thereon. Since the chains cannot slip on the sprockets and, in addition, the stops 92 start out in transverse alignment with one another, both stops will move down together until they engage their eyelets. As they do so, they will push on the hem-bar and lower the shade. Once the hem-bar reaches the window sill 96 it will stop and the weatherstrip along the underside thereof will seal thereagainst. All the time the shade is being lowered, the clutches 40 are disengaged and relative movement between the roller and its end plugs 44 with respect to the inner clutch elements 60 and their sprockets 42 can take place and will to some degree because the coils of the shade may not be tight thus permitting the shade to unwind and tighten without at the same time turning the roller. Also, especially in the case of quilted shades and the like, the constantly varying thickness of the roll on the roller will be such that the roller does not turn at a constant speed and, most certainly, at the same speed as the disengaged sprockets. On the other hand, when lifting the shade up, the sprockets will act through the engaged clutches to turn the roller even though the shade does not start up right away and the stops move away from the hem-bar eyelets. Quite soon, of course, the rotation of the roller will cause the shade to wrap around the latter and raise up.

Generally speaking, the stops 92 on the exposed runs of the bead chains will engage the sprockets 42 and limit the upward excursion of the shade. In the downward direction, on the other hand, when the seal 94 on the bottom of the hem bar strikes the sill 96, there is no reason to lower the shade any further and besides, the eyelets 90 will strike the pulleys thus preventing further rotation of the sprockets, inner clutch elements, shaft and roller. The net result is that there is no necessity for having stops like stops 92 on the hidden runs of the bead chains unless, for some reason, the excursion of the shade needs to be otherwise restricted.

Finally, it was mentioned earlier that some additional structure might be needed in case of an overhead installation covering a skylight or the like where neither of the exposed runs of the bead chain were accessible. While not illustrated, this could easily be handled by providing a remote actuating mechanism in the form of a second sprocket added to one or the other of the inner clutch elements and a separate hand-down bead chain loop or the like reaved around this added sprocket accessible to the operator. It would not be possible, however, to just remove one of the existing bead chains from its pulley and hem bar eye so as to let it hang down because both are needed together with their stops 92 to drive the shade down.

What is claimed is:

1. The drive mechanism for window shades and the like which comprises: a pair of channel-shaped tracks arranged in side-by-side spaced parallel and opposed relation to one another; a pair of drive wheel means positioned in spaced relation atop the tracks for rotation about a common axis extending transversely therebetween; a pair of idler wheel means positioned in spaced relation at the bottom of the tracks for rotation about a common axis extending transversely therebetween in aligned relation with one of the drive wheel means; endless loop actuating means reaved around the aligned drive and idler wheel means; a pair of transversely aligned stop-forming means attached to the actuating means; a shaft extending between the drive wheel means linking same together for conjoint rotation; a roller mounted upon the shaft for relative rotational movement independent thereof; a shade wound upon the roller, said shade having a bottom margin and side margins confined within the channel-shaped tracks for movement therein between a raised and lowered position; rigid means extending along the bottom margin of the shade, said means having eyelets at the opposite ends thereof sized to pass the actuating means while forming abutments to the passage of the stop-forming means; and left and righthanded one way clutch means operatively interconnecting the drive wheel means and the roller, said clutches being operative to engage and form a driving connection between the drive wheel means and said roller effective to raise the shade upon actuation of the actuating means in one direction, and said clutches being operative to disengage the drive wheel means from said roller and permit relative rotational movement to take place therebetween upon actuation of the actuating means in the opposite direction, said stop-forming means and eyelets being operative to interengage with the clutches thus disengaged to lower the shade.

2. The window shade drive mechanism as set forth in claim 1 in which: the drive wheel means comprise bead-chain driven sprockets and the actuating means comprise endless loops of bead chain.

3. The window shade drive mechanism as set forth in claim 1 in which: the actuating means include a hidden run and an exposed run accessible to an operator, and in which the hidden run is housed in the channel-shaped tracks alongside the side margins of the shade.

4. The window shade drive mechanism as set forth in claim 1 in which: each channel-shaped track includes a pair of spaced-apart flanges interconnected by a web, and in which weatherstrip-forming means line the flanges in opposed relation to one another while cooperating to engage and form a weathertight seal with the side margin of the shade moving therebetween.

5. The window shade drive mechanism as set forth in claim 1 in which: weatherstrip-forming means is attached to the bottom margin of the shade adapted to engage and form a weathertight seal against a sill of a window frame in which the shade is mounted when said shade occupies its lowermost position.

6. The window shade drive mechanism as set forth in claim 1 in which: each one-way clutch includes an inner cylindrical member attached to one of the drive wheel means for conjoint coaxial rotation therewith and with the shaft, means including an axially-slotted sleeve mounted in the end of the roller for conjoint rotational movement therewith in encircling coaxially-spaced relation to the inner cylindrical member, and a close-wound helical spring with a radially-extending tang on one end thereof wound around the inner cylindrical member with its tang engaged within the slot in the sleeve to form an operative connection therebetween, rotation of the drive wheel means in a direction to cause the coils of the spring to tighten around the inner cylindrical element being operative to link the latter and the sleeve together for conjoint rotation, and rotation of the drive wheel means in the opposite direction being operative to uncoil and loosen the spring upon the inner cylindrical element and permit the latter to rotate independently of the sleeve.

7. The window shade drive mechanism as set forth in claim 4 in which: the weather strip means, flanges and web cooperate to define a channel housing a length of the actuating means extending between the drive wheel means and the idler wheel means.

8. The window shade drive mechanism as set forth in claim 6 in which: the axially-slotted sleeve comprises a cup-shaped plug having a ribbed outer surface adapted to enter and non-rotatably engage the roller.

* * * * *